United States Patent [19]

Martin

[11] 3,982,713

[45] Sept. 28, 1976

[54] BALLISTIC MISSILE DEFENSE SYSTEM

[75] Inventor: John J. Martin, South Bend, Ind.

[73] Assignee: The United States of America as represented by the Secretary of the Army, Washington, D.C.

[22] Filed: July 22, 1959

[21] Appl. No.: 829,188

[52] U.S. Cl. ..... 244/3.1; 343/9

[51] Int. Cl.[2] ..... F41G 9/00

[58] Field of Search ..... 244/14, 3.1

*Primary Examiner*—Samuel W. Engle
*Assistant Examiner*—Thomas H. Webb
*Attorney, Agent, or Firm*—Nathan Edelberg; Robert P. Gibson; John W. Voigt

EXEMPLARY CLAIM

1. The method of determining the trajectory of a ballistic missile having a trajectory substantially defined by the formula:

$$\ddot{y} = -g + \rho\infty g(\dot{y})^2 / 2\,\beta \sin\gamma$$

$$\ddot{x} = \rho\infty g\,(\dot{x})^2 / 2\,\beta \cos\gamma$$

comprising the steps of measuring the velocity and flight path angle of the missile at a reference altitude, measuring the radiation emitted by the gases in the proximate environment of the missile, measuring the time required for the missile to travel from the reference altitude to the occurrence of maximum radiation, measuring the altitude at which maximum radiation occurs, computing the value of "a" from the following formula:

$$V_E \sin\gamma\, t_{l_{max}} = \int_{y_o}^{(\ln p\, a)/c} e^{ac - cy} dy$$

computing the value of "$\beta$" from the formula:

$$a = \rho_o g / 2c\,\beta \sin\gamma$$

where

- V = velocity at altitude $y$
- $V_E$ = velocity at altitude $y_o$
- $\gamma$ = flight path angle
- $e$ = base of natural logarithms
- $c$ = constant
- $a = \rho_o\, g/2c\,\beta \sin\gamma$
- $\rho_o$ = density of the atmosphere at sea level
- $\rho\infty$ = density of the atmosphere at altitude "$y$"
- $g$ = acceleration due to gravity
- $\beta$ = ballistic coefficient
- $p$ = constant
- $t_l$ = time required for missile to travel from altitude $y_o$ to $y$
- $y$ = altitude at which maximum radiation occurs = (ln p a)/$c$
- $y_o$ = reference altitude
- $y$ = first derivative of altitude with respect to time
- $y$ = second derivative of altitude with respect to time
- $x$ = first derivative of distance in the horizontal plane with respect to time
- $x$ = second derivative of distance in the horizontal plane with respect to time substituting the value of "$\beta$" from the solution of the last mentioned formula in the first mentioned formulas and computing the values of "$y$" and "$x$".

8 Claims, 6 Drawing Figures

INVENTOR.
JOHN J. MARTIN
BY James L. O'Brien
ATTORNEY

INVENTOR.
JOHN J. MARTIN
BY James L. O'Brien
ATTORNEY

INVENTOR.
JOHN J. MARTIN
BY James L. O'Brien
ATTORNEY

INVENTOR.
JOHN J. MARTIN
BY James L. O'Brien
ATTORNEY

INVENTOR.
JOHN J. MARTIN
BY James L. O'Brien
ATTORNEY

BALLISTIC MISSILE DEFENSE SYSTEM

The present invention relates generally to a ballistic missile defense system and more particularly to a method and apparatus in such a system for determining the ballistic coefficient and/or trajectory of a missile.

In order to predict the trajectory of a ballistic missile it is necessary to know its ballistic coefficient; and in order to effect the brachistochronic destruction of a missile it is desirable that the trajectory thereof be predicted at the earliest possible moment.

Ballistic coefficient ($\beta$) is defined by the equation $$\beta = W/C_D A$$

where $W$ is the weight of the missile, $C_D$ the coefficient of drag and A the cross sectional area of the missile. From the above equation it is evident that the parameters of ballistic coefficient cannot be directly measured for an unknown missile in flight. Therefore, if the ballistic coefficient is to be known, resort must be had to indirect measurement. It has heretofore been proposed to indirectly measure or determine the ballistic coefficient from radar measurements of the change of position of the missile with time. Since the radar system requires discrete measurements spaced in time it is relatively slow to determine the ballistic coefficient. Due to the requirement of having to make discrete measurements spaced in time, the radar system is equally slow to detect any changes in the ballistic coefficient of the warhead such as might be caused by staging, re-entry propulsion, drag brakes and deformation due to heat. A radar system is also subject to being deceived or jammed by other objects in the target complex which may include decoys, balloons, missile tank fragments, chaff, and electronic, infra red ultra violet jammers.

I have discovered that the radiation from the gas in the proximate environment of a ballistic missile may be utilized to determine the ballistic coefficient of a missile. The method and apparatus of the present invention, utilizing the passively emitted radiation from gas adjacent the missile, is not easily jammed or deceived and will determine the ballistic coefficient of a missile at least as early as and in most cases earlier than a system utilizing radar alone. Furthermore, the apparatus and method of the present invention will substantially instantaneously detect any change in the ballistic coefficient, or re-entry propulsion.

It is an object of the present invention to provide a system and method utilizing radiation emitted from the gas adjacent a missile to determine the ballistic coefficient of the missile.

It is another object of the present invention to provide a system and method for predicting the trajectory of a ballistic missile which is not easily jammed or deceived.

It is a further object of the present invention to provide a system and method for providing early warning of a change in ballistic coefficient of a missile, or re-entry propulsion.

Other objects and advantages of my invention will become readily apparent from the following detailed description taken in connection with the appended drawings in which.

Figure 1:
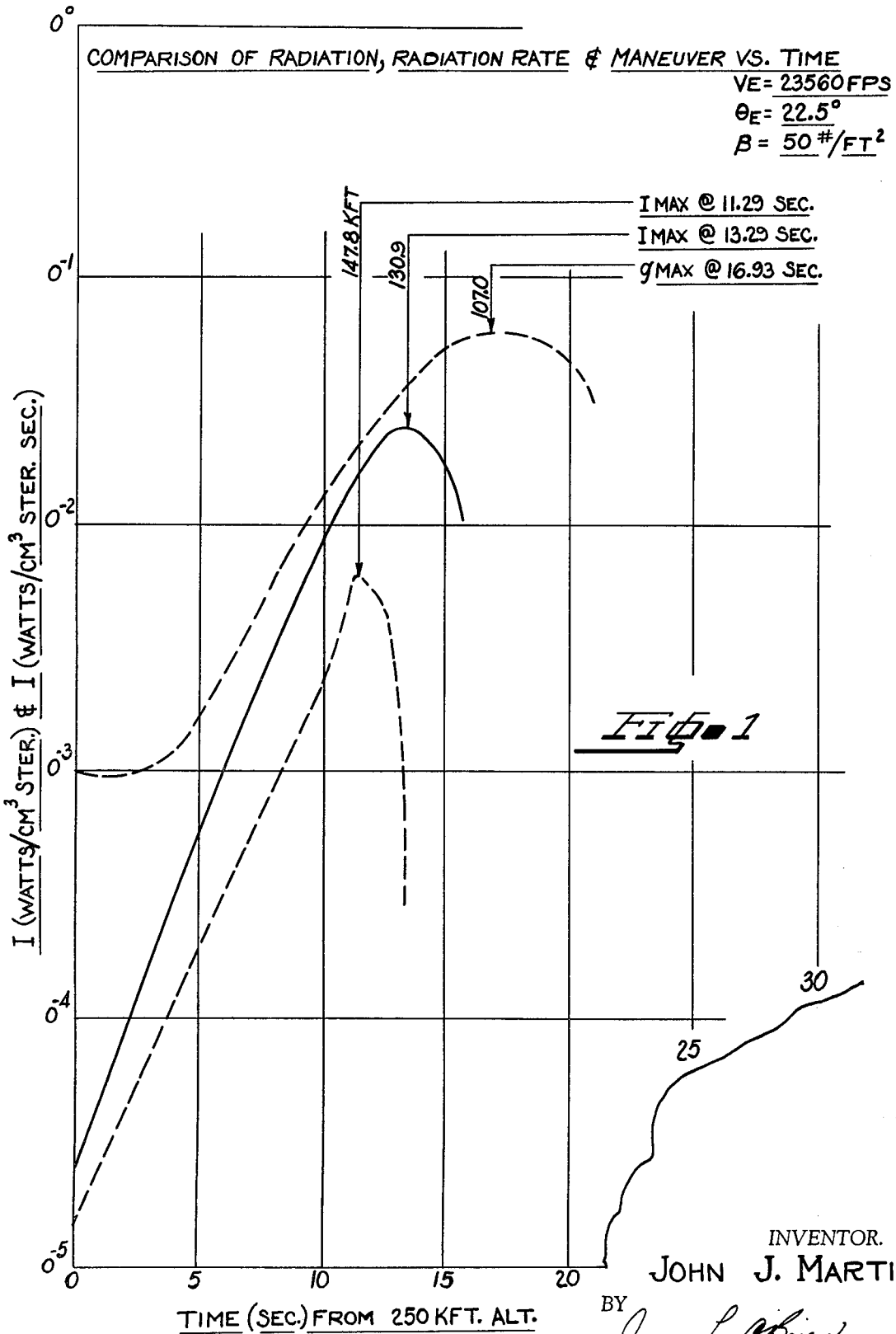
FIG. 1 is a graph showing typical changes of radiation and radiation rate as a function of time.

The trajectory of a ballistic missile may be defined in the usual cartesian coordinates by the equations:

$$\ddot{y} = -g + \rho_\infty g (\dot{y})^2/2 \beta \sin \gamma \quad (1)$$

$$\ddot{x} = \rho_\infty g (x)^2 / 2 \beta \cos \gamma \quad (2)$$

where $\dot{y}$ = first derivative of altitude with respect to time $\ddot{y}$ = second derivative of altitude with respect to time $\dot{x}$ = first derivative of horizontal distance with respect to time $\ddot{x}$ = second derivative of horizontal distance with respect to time $g$ = acceleration due to gravity $\rho_\infty$ = ambient air density $\beta$ = ballistic coefficient: $W/C_D A$ $W$ = weight of the missile $C_D$ = coefficient of drag based on A A = cross sectional area of the missile $\gamma$ = flight path angle of the missile The symbols used herein will retain their meaning throughout the specification.

With the assumption that the effect of gravity is negligible at the high accelerations involved, the equation for "$\ddot{y}$" may be solved independently and yields the result that $$V = V_E e^{-ae^{-cy}} \quad (3)$$

where

V = velocity at any altitude, $y$ $V_E$ = velocity at a reference altitude (velocity before any appreciable slowdown occurs due to atmospheric drag)

$e$ = base of natural logarithms $a = \rho_o g C_D A/2 c W \sin \gamma$ $$c = -\frac{\ln[\rho(y_1)/\rho(y_2)]}{y_1 - y_2};$$

in the range of interest $c$ is substantially constant and has a value of 1/22000 $ft^{-1}$ $\rho_o$ = density of the atmosphere at sea level The present invention involves a method and apparatus utilizing radiation information from the electromagnetic radiation emitted by the gas in the shock wave or proximate environment of a missile for determining the ballistic coefficient of the missile. The determined value of the ballistic coefficient may then be utilized in equations (1) and (2) to compute or predict the trajectory of the missile.

The radiation emitted by the gas at the stagnation point of a ballistic missile is defined by the empirical equation:

$$I = [I_o/8000^{10} (0.85)] T^{10} \rho_s/\rho_\infty \cdot \rho_\infty/\rho_o \quad (4)$$

where

I = radiation in watts/cm³ steradian $I_o$ = constant dependent upon radiation wave length interval T = temperature of the gas in the shock wave in degrees Kelvin $\rho_s$ = density of the gas at the stagnation point of the shock wave The total radiation is proportional to that of the stagnation point. Temperature (T), density ratio across the shock wave ($\rho_s/\rho_\infty$) and ratio of ambient density to sea level density ($\rho_\infty/\rho_o$) may be expressed as follows:

$$T \propto V^q$$

$$\rho_s/\rho_\infty \; V^m$$

$$\rho_\infty/\rho_o \propto e^{-cy}$$

where the value of $q$ is between ½ and 1 and the value of $m$ is between 0 and 1. The radiation equation (4) may then be expressed as:

$$I \propto V^{10q} V^m e^{-cy} = V^p e^{cy} \tag{5}$$

where $p = 10q + m$ and therefore has a value between 5 and 11. The time derivative of equation (5) is:

$$\dot{I} \propto c \sin\gamma \, V^{p+1} e^{cy} (p a e^{cy} - 1)$$

and the radiation intensity maximizes when I is zero such that:

$$p a e^{cy} - 1 = 0$$

Therefore I is a maximum if $$a e^{-cy} = 1/p \tag{6}$$

and from equation (3) the velocity ratio corresponding to the maximum of radiation intensity, $I_{max}$, occurs when:

$$(V/V_E)\, I_{max} = e^{-1/p} \tag{7}$$

and from equation (6) the altitude at which this occurs is:

$$y_{I_{max}} = (\ln p a)/c \tag{8}$$

I have found that a fixed velocity ratio ($V/V_E$) exists for other orders of time rate derivatives of radiation and that the general case of equations (7) and (8) may be expressed as:

$$(V/V_E)_{(d^n I/dt^n)_{max}} = e^{-1/\Psi(p,n)} \tag{9}$$

$$y_{(d^n I/dt^n)_{max}} = \frac{1}{c} \ln [\psi(p, n)]\, a \tag{10}$$

where $n$ equals the order of time rate derivative of radiation and $\Psi(p,n)$, is some function of $p$ and $n$. In the present state of the computer art $n$ is limited to 0, 1 or 2. The following table correlates values of $n$ with values of $\Psi(p,n)$ and $V/V_E$:

| n | ψ(p,n) | $V/V_E$ |
|---|---|---|
| 0 | 6.25 | 0.855 |
| 1 | 17 | 0.945 |
| 2 | 43 | 0.977 |

From equation (8) I have derived the following equation for determining the ballistic coefficient, $\beta$, of the missile:

$$y_{I_{max}} = \frac{1}{c} \ln p a = \frac{1}{c} \ln \left[ \frac{p \rho_o g}{2c \beta \sin\gamma} \right]$$

$$\therefore \beta = \frac{p \rho_o g e^{-cy} I_{max}}{2c \sin\gamma} = \frac{\rho_o g/2c}{\frac{\sin\gamma}{p} e^{cy} I_{max}} \tag{11}$$

For any given conditions of atmospheric density, $\rho_o g/2c$ is a constant, K, and for a standard day K is equal to 1200. Thus equation (11) may be rewritten as:

$$\beta = \frac{K}{\frac{\sin\gamma}{p} e^{cy} I_{max}} \tag{12}$$

From equation (12) the ballistic coefficient, $\beta$, may be computed once the flight path angle, $\gamma$, and the altitude at which maximum radiation, $y_{I_{max}}$, occurs are known.

From equation (10) the general equation for the ballistic coefficient is:

$$\beta = \frac{K}{\frac{\sin\gamma}{\Psi(p,n)} e^{cy} (d^n I/dt^n)_{max}} \tag{13}$$

Once the ballistic coefficient, altitude, horizontal distance and flight path angle are known, the entire trajectory of the missile may be computed from equations 1 and 2.

In some ballistic missile defense systems it may be convenient to use time as the independent variable. The present invention includes the method and apparatus for determining the trajectory of a missile through the measurement of the time required for the missile to travel from a reference altitude to the altitude at which maximum radiation occurs, considering as boundary conditions missile velocity at the reference altitude, flight path angle and ballistic coefficient:

The equation for velocity of the missile may be written as:

$$dt = dy/V \sin\gamma$$

which from equation (3) may be rewritten as:

$$dt = e^{ae^{-cy}} dy/V_E \sin\gamma \tag{14}$$

Equation (14) may be integrated to yield:

$$V_E \sin\gamma \, t_{I_{max}} = \int_{y_o}^{(\ln pa)/c} e^{ae^{-cy}} dy \tag{15}$$

where:

$y_o$ = reference altitude—altitude before any appreciable slowdown of the missile due to atmospheric drag has occurred, 250,000 ft. may be used as an appropriate reference altitude $\frac{(\ln p\ a)}{c} = y_{I_{max}}$ = altitude at which maximum radiation occurs $t_{I_{max}}$ = time required for missile to travel from altitude $y_o$ to $y_{I_{max}}$ The value of "$a$" may be computed from equation (15) and the value of "$\beta$" computed from the equation:

$$a = \rho_o\ g/2c\ \beta \sin \gamma \qquad (16)$$

The value of "$\beta$" thus obtained may be substituted in equations (1) and (2) and the values of "$\dot{y}$" and "$\dot{x}$" computed whereby the trajectory of the missile may be predicted.

FIG. 1 illustrates, for a particular ballistic missile, radiation and radiation rate as a function of time measured from a reference altitude. The curves of FIG. 1 are representative for ballistic missiles having a constant ballistic coefficient and it is to be noted that the curves are continuous.

Figure 2:
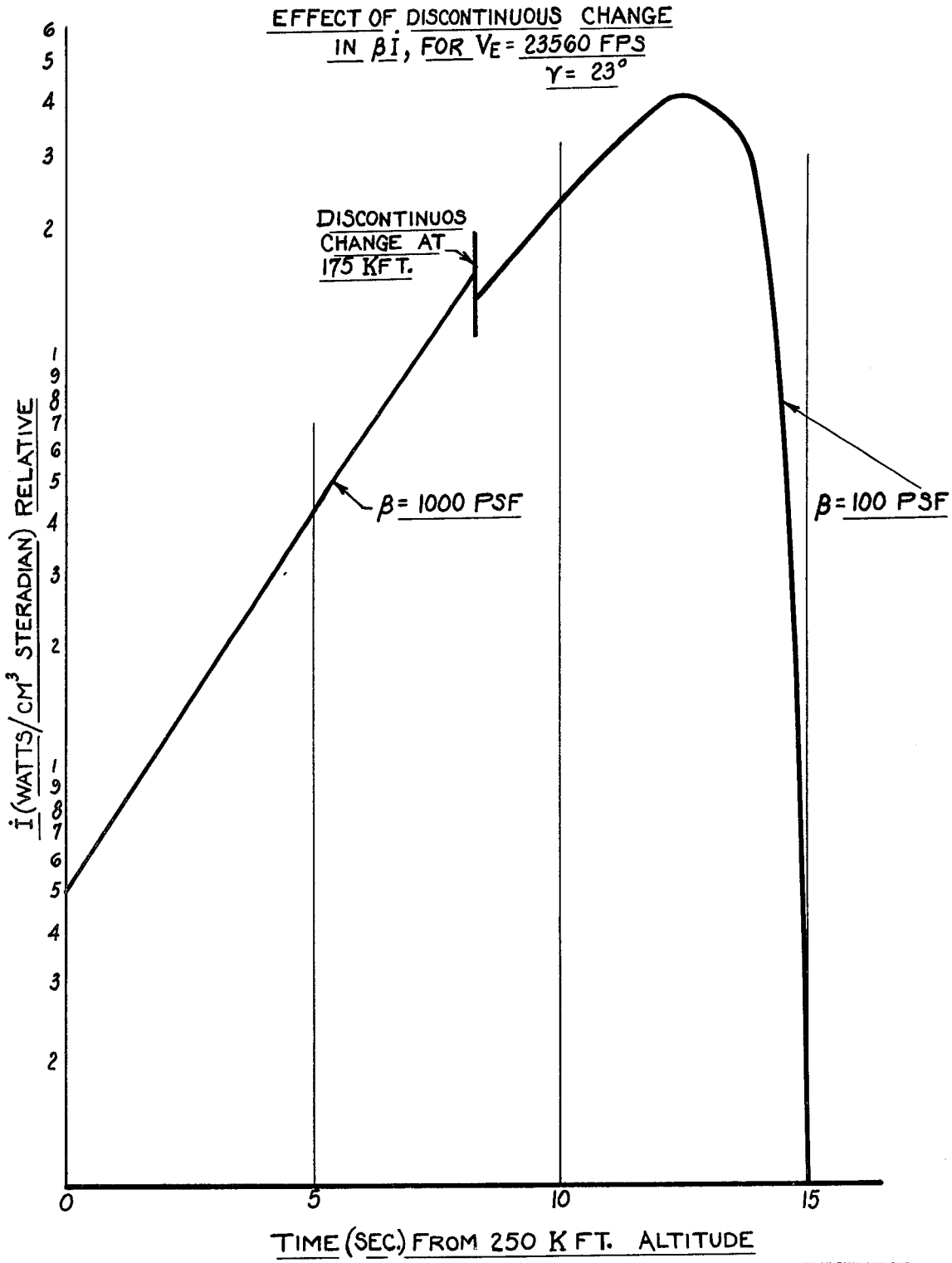
FIG. 2 is a graph similar to the graph of FIG. 1 showing the effect of a change in ballistic coefficient.

If the ballistic coefficient of the missile should change as by change of shape or weight of the missile or for any other reason the change of radiation with respect to time i.e., the derivative of radiation with respect to time will be abrupt or discontinuous. FIG. 2 illustrates the effect of a change in ballistic coefficient on the curves shown in FIG. 1. Thus by comparing instantaneous values of radiation with immediately proceeding values of radiaton and detecting any abrupt or discontinuous changes in radiation with time early warning of the occurrence of a change in ballistic coefficient is obtained. Similarly the detection of an abrupt or discontinuous change in the nth derivative of radiation with respect to time (where $n$ is 0, 1 or 2) will also provide early warning of the occurrence of a change in ballistic coefficient.

Figure 3:
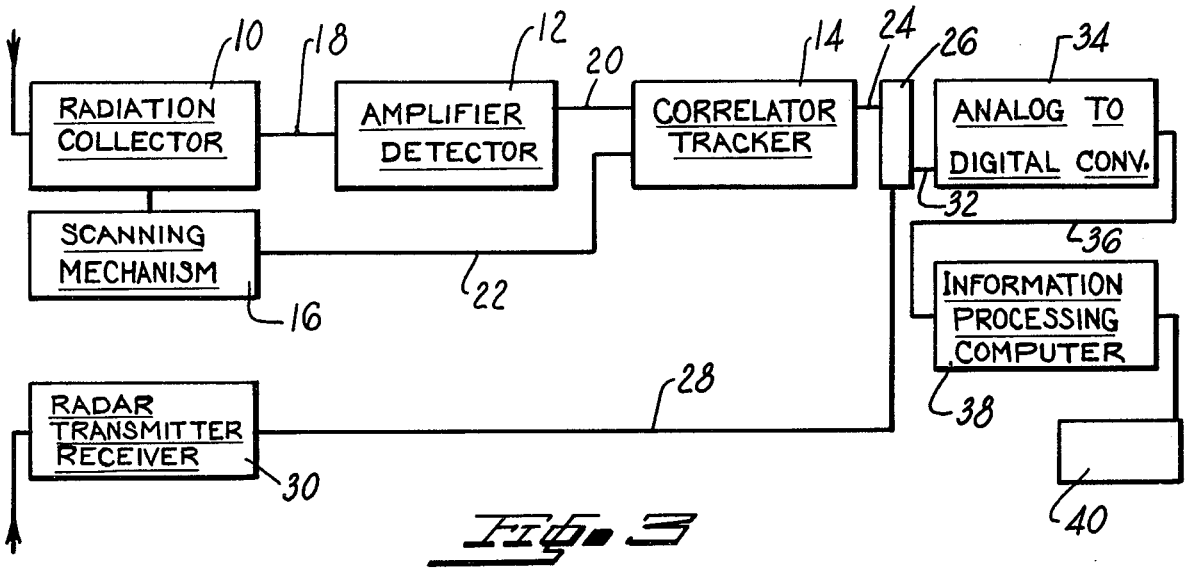
FIG. 3 is a schematic view of a ballistic missile defense system embodying the present invention.

Referring now to FIG. 3, numeral 10 designates a radiation collector or sensor, 12 a detector - amplifier, 14 a correlator and 16 a scanning device. Sensor 10 generates an output signal indicative of the amount of radiation received which is transmitted through an appropriate conductor 18 to the detector-amplifier 14 wherein the signal from the desired radiation wave length is detected and amplified and further transmitted through a conductor 20 to correlator 14.

The scanning device 16 is connected to collector 10 and defines and/or controls the spatial reception zone of the collector. Scanning device 16 generates an output signal indicative of the azimuth and elevation angle of the reception zone of collector 10 which is transmitted via conductor 22 to correlator 14 wherein the output signals from sensor 10 and scanning device 16 are correlated in time and space. Correlator 14 is connected by a conductor 24 to a parallax computer 26 which in turn is connected by a conductor 28 to a radar or echo ranging means 30. Radar 30 generates an output signal indicative of the velocity, flight path angle, altitude and horizontal distance of the missile. The parallax computer 26 compensates for any differences between the lines - of - sight of said sensor 10 and radar 30. The output of computer 26 is transmitted via conductor 32 to an analog to digital converter 34 which discharges the sensor and radar received information as digital bits via conductor 36 to the information processing computer 38.

Computer 38 is programmed to compute the value of the ballistic coefficient from the equation (13) and the values of "$\dot{y}$" and "$\dot{x}$" from equations (1 ) and (2) Computer 38 may also be programmed to compute the value of "$a$" from equation (15) and the value of "$\beta$" from equation (16) and thence the values of "$\dot{y}$" and "$\dot{x}$" from equations (1) and (2). Standard or measured values for atmospheric density are manually set into the computer 40.

In some installations radar 30 may supply raw information consisting of range, bearing and elevation angle to computer 38 via parallax computer 26 and converter 34 in which case computer 40 is additionally programmed to compute the velocity, altitude and horizontal distance of the missile from the radar information. Although the flight path angle is preferably measured by radar 30, this measurement may be accomplished by sensor 10 and scanning device 16.

The radiation input to the sensor 10 is affected by the changing distance between the source of radiation and sensor, i.e., $I_{sensor} \sim I_{source}/r^2$ where $r$ equals the range between the source and the sensor. Computer 40 is programmed to compensate the measured radiation as a function of change in range. Where a time derivative of radiation is utilized the corresponding degree of time derivative of range is utilized in the computer program.

Figure 4:
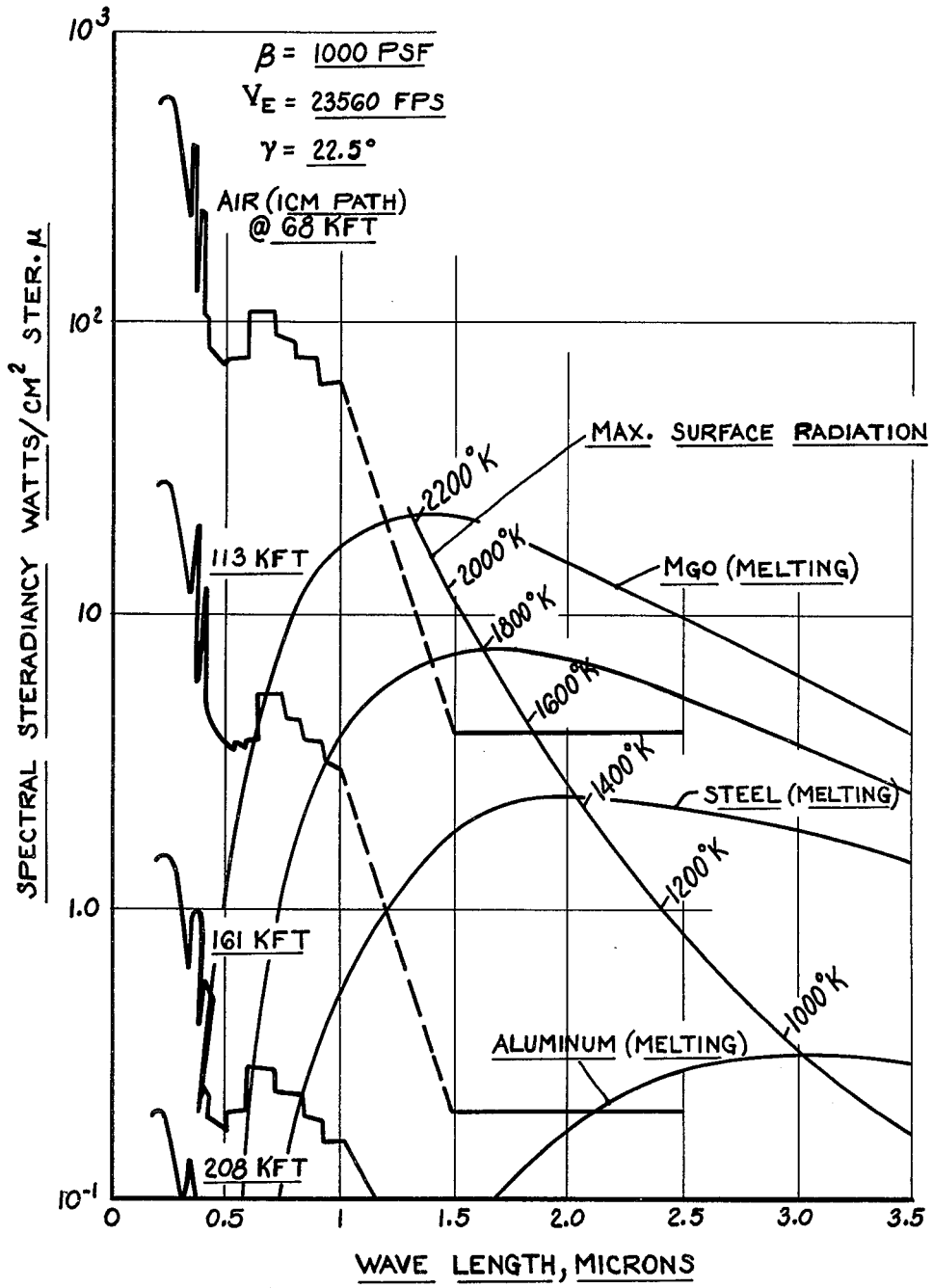
FIG. 4 is a graph of the spectral distribution of gaseous and surface radiation.
Figure 5:
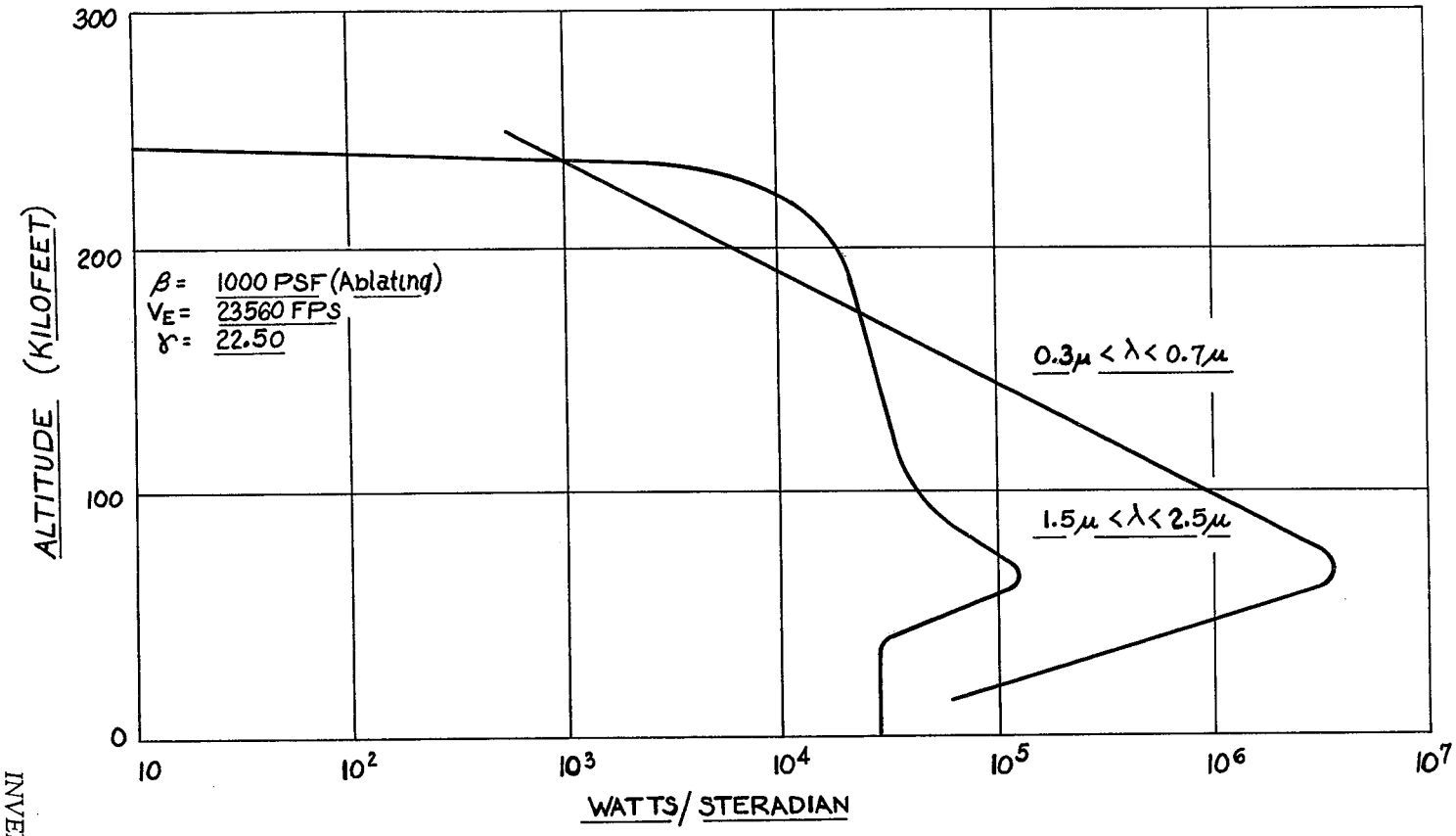
FIG. 5 is a graph showing the total gaseous and surface radiation from a missile at different wave lengths.

FIG. 4 compares the spectral distribution of gaseous and surface radiation; and as shown therein the curve of maximum surface radiation lies in the spectrum at wave lengths greater than one micron whereas the maximum gaseous radiation occurs in the spectrum at less than one micron in wave length. In a preferred embodiment an electronically scanned optical detector sensitive to radiation in the wave lengths from 0.3 to 0.7 microns is utilized for sensor 10 and scanning device 16. Several such detectors are available, such as the dissector tube, iconoscope, image orthicon tube and the vidicon tube. The preferred range of radiation wave lengths from 0.3 to 0.7 microns offers several advantages viz. maximum power of gaseous radiation occurs in this region, on cloudless days the atmosphere is transparent in this region and the available radiation detectors are most sensitive in this region. In other embodiments, however, longer wave lengths may be utilized such as 1.5 to 8.0 microns. In the longer wave length region the radiation received by the sensor 10 is the total of surface and gaseous radiation; but as noted in FIG. 5 which illustrates typical curves of radiation vs altitude measured at two different wave lengths the maximum of gaseous radiation may still be measured in the longer wave length portion of the spectrum.

Sensor 10 may be airborne or otherwise located in space at sufficiently high altitude to avoid clouds or other atmospheric interference to the reception of radiation. In this event a radio data link is substituted for the conductor 24. In some installations sensor 10 may be bore sighted with the radar antenna in which case the parallax computer 26 may be omitted.

Figure 6:
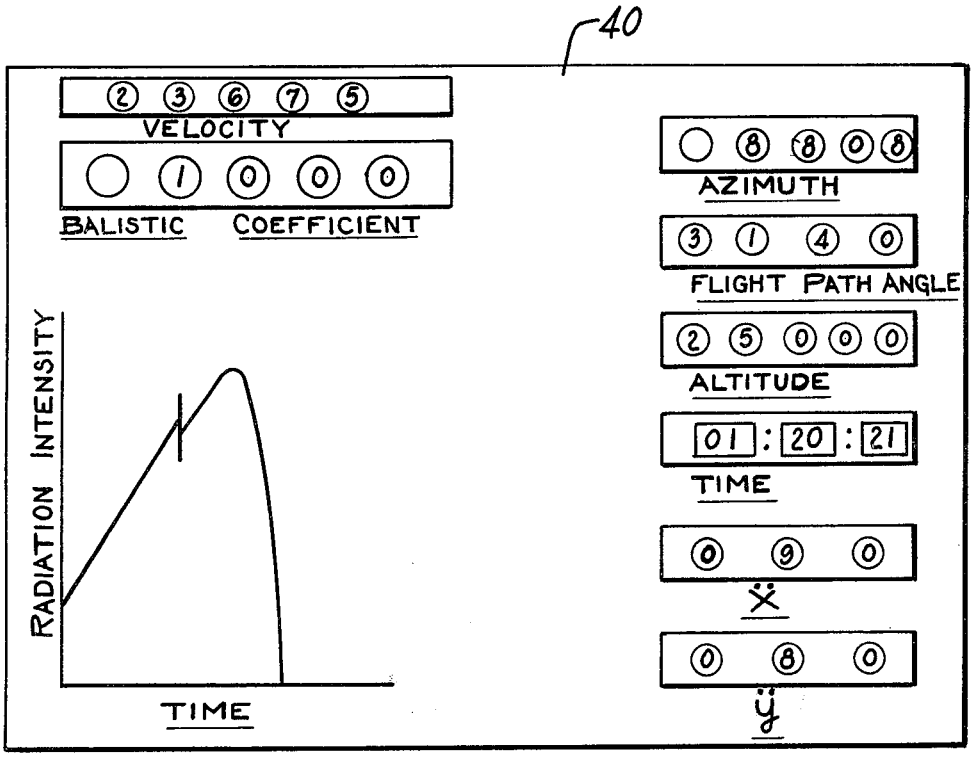
FIG. 6 is an elevation view of an information display panel.

The computer 38 may be a suitably programmed IBM Model 650 or Bendix Model G15D or other type of suitable capacity. The information output from computer 38 may be recorded on either magnetic tape or film and also suitably displayed as shown in FIG. 6.

Although a particular embodiment of my invention has been described, it will be understood by those skilled in the art that the objects of the invention may be attained by the use of constructions different in certain respects from that disclosed without departing from the underlying principles of the invention.

I claim:

1. The method of determining the trajectory of a ballistic missile having a trajectory substantially defined by the formula:

$$\ddot{y} = -g + \rho_\infty g(\dot{y})^2/2\,\beta \sin\gamma$$

$$\ddot{x} = \rho_\infty g\,(\dot{x})^2/2\,\beta \cos\gamma$$

comprising the steps of measuring the velocity and flight path angle of the missile at a reference altitude, measuring the radiation emitted by the gases in the proximate environment of the missile, measuring the time required for the missile to travel from the reference altitude to the occurrence of maximum radiation, measuring the altitude at which maximum radiation occurs, computing the value of "$a$" from the following formula:

$$V_E \sin\gamma\, t_{l_{max}} = \int_{y_o}^{(\ln p\, a)/c} e^{ae^{-cy}} dy$$

computing the value of "$\beta$" from the formula:

$$a = \rho_o g/2c\,\beta \sin\gamma$$

where $V$ = velocity at altitude $y$
$V_E$ = velocity at altitude $y_o$
$\gamma$ = flight path angle
$e$ = base of natural logarithms
$c$ = constant
$a = \rho_o g/2c\,\beta \sin\gamma$
$\rho_o$ = density of the atmosphere at sea level
$\rho_\infty$ = density of the atmosphere at altitude "$y$"
$g$ = acceleration due to gravity
$\beta$ = ballistic coefficient
$p$ = constant
$t_{l_{max}}$ = time required for missile to travel from altitude $y_o$ to $y$
$y$ = altitude at which maximum radiation occurs = (ln p a )/ c
$y_o$ = reference altitude
$\dot{y}$ = first derivative of altitude with respect to time
$\ddot{y}$ = second derivative of altitude with respect to time
$\dot{x}$ = first derivative of distance in the horizontal plane with respect to time
$\ddot{x}$ = second derivative of distance in the horizontal plane with respect to time substituting the value of "$\beta$" from the solution of the last mentioned formula in the first mentioned formulas and computing the values of "$\ddot{y}$" and "$\ddot{x}$".

2. The method of determining the ballistic coefficients of a ballistic missile comprising the steps of measuring the radiation emitted by the gases in the proximate environment of the missile, computing time rate derivatives of radiation in accordance with the expression $d^nI/dt^n$ where $n$ is 0, 1 or 2, measuring the altitude at which the maximum value of $d^nI/dt^n$ occurs, measuring the flight path angle of the missile at a reference altitude, and computing the ballistic coefficient from the formula:

$$\beta = \frac{K}{\frac{\sin\gamma_E}{\Psi(p,n)} e^{cy} (d^nI/dt^n)_{max}}$$

where $\beta$ = ballistic coefficient

K & $c$ = constants
$\gamma_E$ = flight path angle at a reference altitude
$p$ = gas dynamic constant
$n$ = order of time rate derivative (0, 1 or 2)
$e$ = base of natural logarithms
$\Psi(p,n)$ = is some function of $n$ and $p$
$y\ (d^nI/dt^n)_{max}$ = altitude at which maximum value of $(d^nI/dt^n)$ occurs.

3. The method of determining the ballistic coefficient of a ballistic missile comprising the steps of measuring the flight path angle of the missile, measuring the radiation emitted by the gases in the proximate environment of the missile, measuring the altitude at which the maximum of radiation occurs, and computing the ballistic coefficient from the formula:

$$\beta = \frac{1200}{\frac{\sin\gamma}{p} e^{cy}}$$

where $\beta$ = ballistic coefficient
$\gamma$ = flight path angle
$y$ = altitude at which maximum of radiation occurs
$c$,$e$ and $p$ = constants 4. The method of detecting a change in the ballistic coefficient of a ballistic missile comprising the steps of measuring the radiation emitted by the gases in the proximate environment of the missile as a function of time and comparing instantaneous values of radiation with immediately preceding values of radiation and detecting any abrupt changes in radiation with time, said abrupt changes in radiation indicating a change in ballistic coefficient.

5. The method of detecting a change in the ballistic coefficient of a ballistic missile comprising the steps of measuring the radiation emitted by the gases in the proximate environment of the missile, taking the nth derivative of radiation with respect to time wherein $n$ is 0, 1 or 2, and detecting any abrupt changes in the radiation derivative, said abrupt changes in derivatives indicating a change in ballistic coefficient.

6. In a ballistic missile defense system, radiation collector means for generating an output signal in response to radiation emitted by the gas adjacent the missile, echo ranging means for generating an output signal indicative of the altitude and flight path angle of the missile, and computer means operatively connected to said radiation collector means and said echo ranging means and reponsive to said output signals for generating an output signal according to the law:

$$\frac{K}{\frac{\sin\gamma}{p} e^{cy}}$$

where $y$ is the altitude of the missile at the occurrence of maximum output signal of said collector means, $\gamma$ is the flight path angle of the missile and K, $p$, $e$ and $c$ are constants, the output signal of said computer being indicative of the ballistic coefficient of the missile.

7. In a ballistic missile defense system radiation collector means for generating an output signal in proportion to the received radiation emitted by the gas adjacent the missile, scanning means operatively connected to said collector means, echo ranging means for generating an output signal indicative of the altitude and flight path angle of the missile, scanning means operatively connected to said echo ranging means, correlator means operatively connected to both of said scanning means and said collector means and echo ranging means for correlating said output signals in time and space, and computer means operatively connected to said correlator means and responsive to said output signals for generating an output signal indicative of the ballistic coefficient "$\beta$" of the missile in accordance with the equation:

$$\beta = \frac{K}{\frac{\sin \gamma}{p} e^{cy}}$$

where $y$ is the altitude of the missile at the occurrence of the maximum radiation output signal, $\gamma$ is the flight path angle of the missile and K, $p$, $e$ and $c$ are constants.

8. In a ballistic missile defense system radiation collector means for generating an output signal in proportion to the received radiation emitted by the gas adjacent the missile, means for generating an output signal indicative of the altitude and flight path angle, and computer means operatively connected to both of said previously mentioned means for generating an output signal according to the law:

$$\frac{K}{\frac{\sin \gamma}{\Psi(p, n)} e^{cy(d^n I/d^n)_{max}}}.$$

where $\gamma$ = flight path angle of the missile $n = 0$, 1 or 2 order of time rate derivative of radiation $y\ (d^n I/dt^n)_{max}$ = altitude at which the nth time derivative of radiation is maximum $K, p, e$ and $c$ = constants $\Psi\ (p,n)$ = some function of $p$ and $n$ the output signal of said computer being indicative of the ballistic coefficent of the missile.

* * * * *